US007408476B1

(12) United States Patent
Beaton

(10) Patent No.: US 7,408,476 B1
(45) Date of Patent: Aug. 5, 2008

(54) EMERGENCY SHUT-OFF SYSTEM AND METHOD OF USING SAME

(76) Inventor: Dean Christopher Beaton, 7309 Laura Ct., San Diego, CA (US) 92120

( * ) Notice: Subject to any disclaimer, the term of this patent is extended or adjusted under 35 U.S.C. 154(b) by 430 days.

(21) Appl. No.: 11/010,033

(22) Filed: Dec. 11, 2004

(51) Int. Cl.
*G08B 23/00* (2006.01)

(52) U.S. Cl. ..... 340/693.5; 340/693.9; 340/693.11; 340/426.24; 340/464; 362/85; 362/95; 362/324

(58) Field of Classification Search ..... 340/693.5, 340/693.9, 693.11, 426.24, 464; 362/95, 362/85, 234, 324
See application file for complete search history.

(56) References Cited

U.S. PATENT DOCUMENTS 4,267,549 A * 5/1981 Taylor ..... 340/302
4,739,187 A * 4/1988 Nelson et al. ..... 307/118
5,775,456 A * 7/1998 Reppas ..... 180/322
6,000,807 A * 12/1999 Moreland ..... 362/95
6,044,257 A * 3/2000 Boling et al. ..... 455/404.2
6,059,536 A * 5/2000 Stingl ..... 417/44.2

* cited by examiner

*Primary Examiner*—Tai Nguyen
(74) *Attorney, Agent, or Firm*—Steins & Associates, P.C.

(57) ABSTRACT

An emergency shut-off system includes an emergency shut-off switch cover plate with a hinged cover that cooperates with a conventional emergency shut-off switch to help prevent the unintended shut-down of a pool or spa water pumping system. The emergency shut-off switch cover plate and hinged cover function in one mode of operation to prevent the unintended shutdown of the pumping system. In another mode of operation, the emergency shut-off cover plate and hinged cover provide a user with a immediate sensory indication that the pumping system is shut-down and needs to be re-activated. The sensory indication can be either a highly visual indication or in the alternative a combination of the highly visual indication with an audible sensory indication.

10 Claims, 6 Drawing Sheets

EMERGENCY SHUT-OFF SYSTEM AND METHOD OF USING SAME

STATEMENT REGARDING FEDERALLY SPONSORED RESEARCH OR DEVELOPMENT

[Not Applicable]

REFERENCE TO MICROFICHE APPENDIX

[Not Applicable]

CROSS-REFERENCE TO RELATED APPLICATIONS

[Not Applicable]

BACKGROUND OF THE INVENTION

1. Field of the Invention

This application relates to emergency shut-off systems and alarm indications, and more particularly to emergency shut-off system for a pool or spa pumping system and a sensory alarm provider for when the pumping systems is disabled.

2. Background of Prior Art

Emergency shut-off systems for pools and spas are well known in the prior art. However, there is a need for a new and improved emergency shut-off system that is not only low cost and convenient to use, but also which provides a user or maintenance person with an immediate indication that emergency shut-off system has been activated to place the system in a shutdown mode.

BRIEF SUMMARY OF THE INVENTION

In a preferred embodiment of the invention an emergency shut-off system includes an emergency shut-off switch cover plate, which cooperates with a conventional emergency shut-off switch and a hinged alarm box, to help prevent the unintended shut-down of a pool or spa water pumping system. The emergency shut-off switch cover plate and hinged alarm box function together in one mode of operation to prevent the unintended shutdown of the pumping system. In another mode of operation, when there is an emergency, they function together to provide a user with immediate assistance in locating where the emergency shutdown switch is located. In this same mode of operation, the person responding to the emergency, is required to raise the hinged alarm box away from the bottom portion of the emergency shut-off cover plate in order to activate the emergency shut-off switch. Once the emergency shut-off switch is actuated the user releases the alarm box allowing it to fall under the force of a coil spring (not shown) to an alarm position to provide the user with an immediate sensory indication that pumping system is shut-down and needs to be re-activated when the emergency situation has been resolved. In this regard, the sensory indication can be either a highly visual indication or in the alternative a combination of the highly visual indication with an audible sensory indication.

BRIEF DESCRIPTION OF THE DRAWINGS

The above mentioned features and steps of the invention and the manner of attaining them will become apparent, and the invention itself will be best understood by reference to the following description of the embodiments of the invention in conjunction with the accompanying drawings wherein.

DETAILED DESCRIPTION OF THE PREFERRED EMBODIMENT OF THE INVENTION

Figure 1:
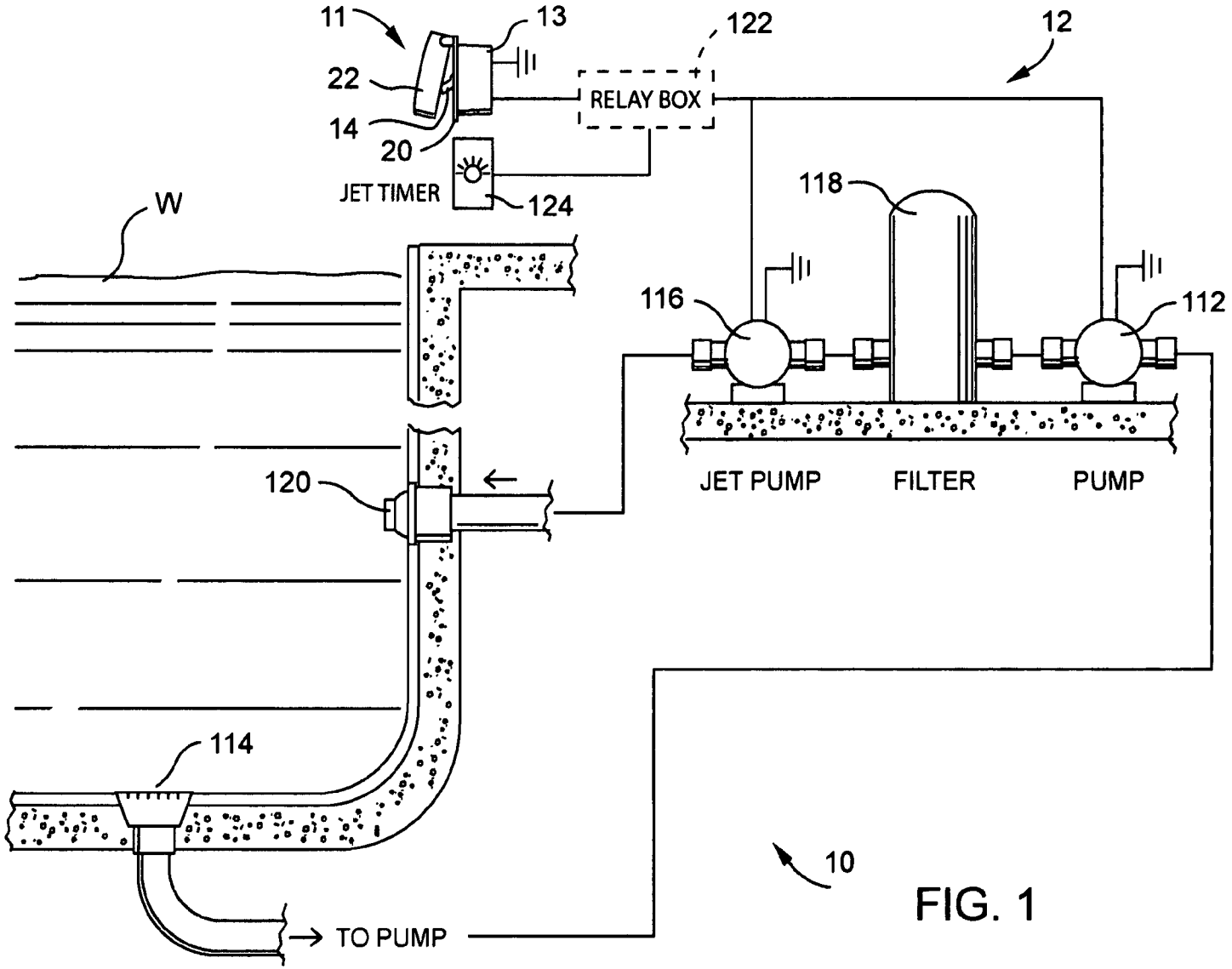
FIG. 1 is a diagrammatic view of an emergency shut-off system, which is constructed in accordance with the present invention.
Figure 2:
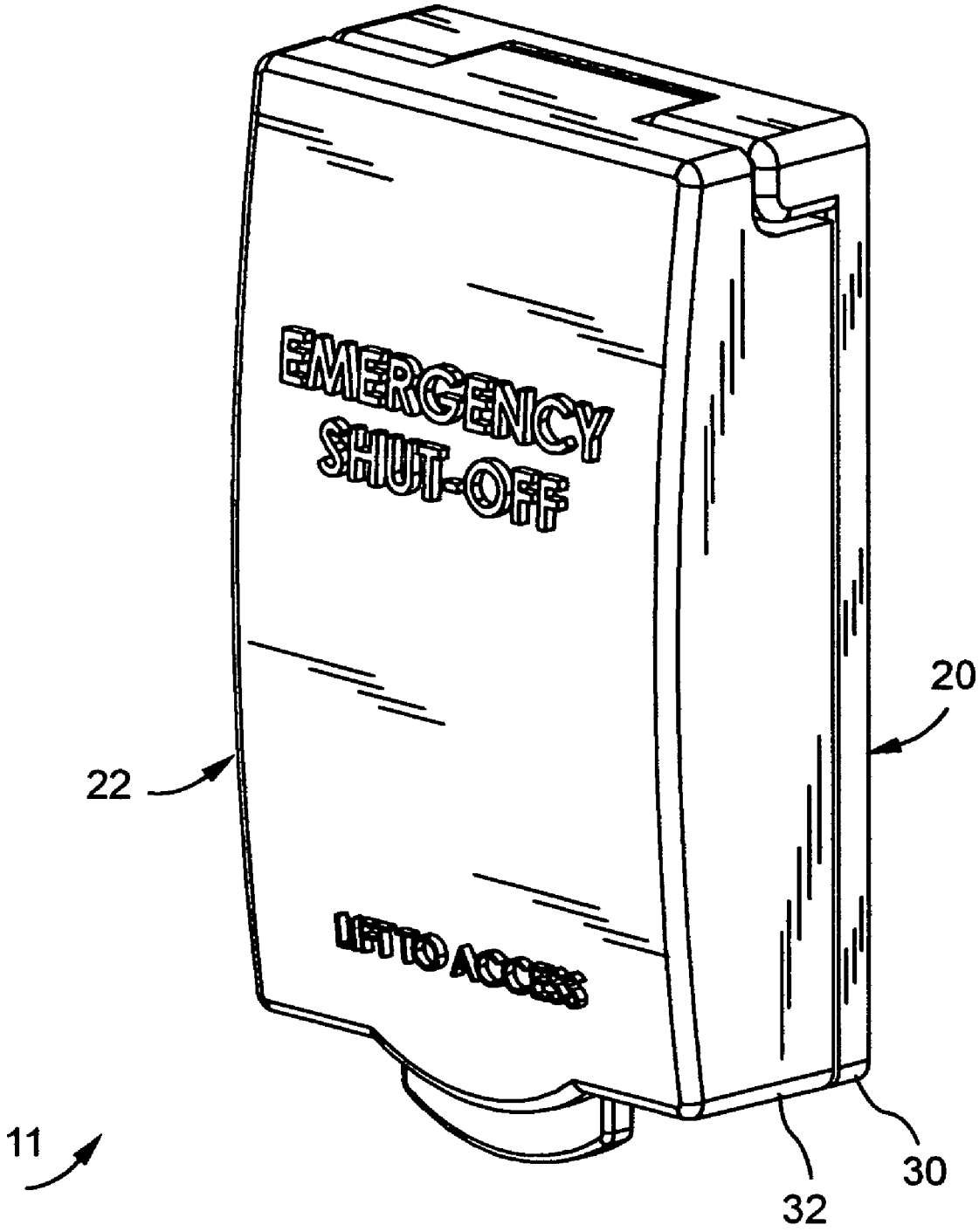
FIG. 2 is a greatly enlarged perspective view of an emergency shut-off cover plate with hinged cover, which forms part of the emergency shut-off system of FIG. 1.
Figure 3:
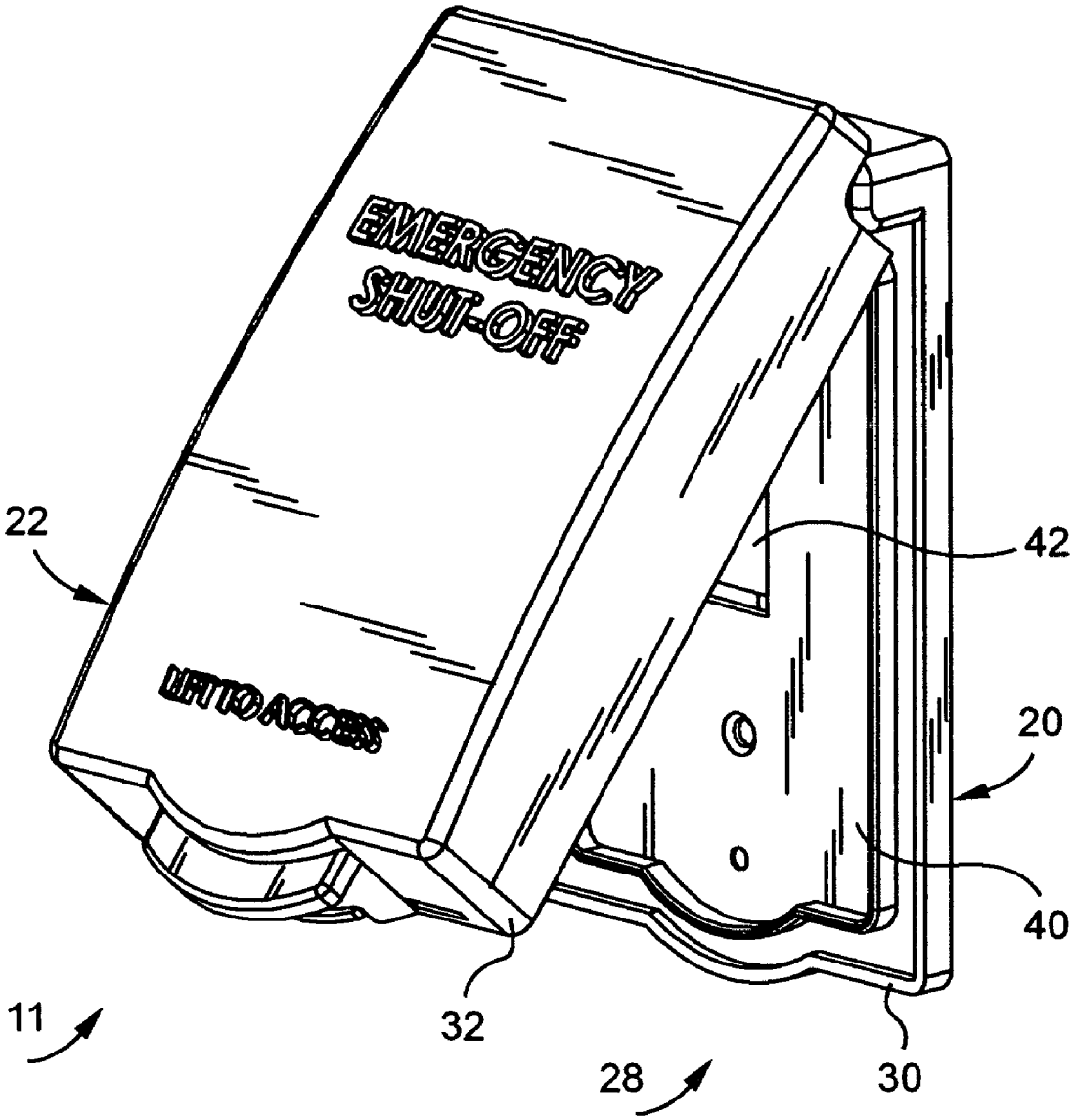
FIG. 3 is another perspective view of the emergency shut-off cover plate with hinged cover of FIG. 2, illustrating the hinged cover in a partially opened position.
Figure 4:
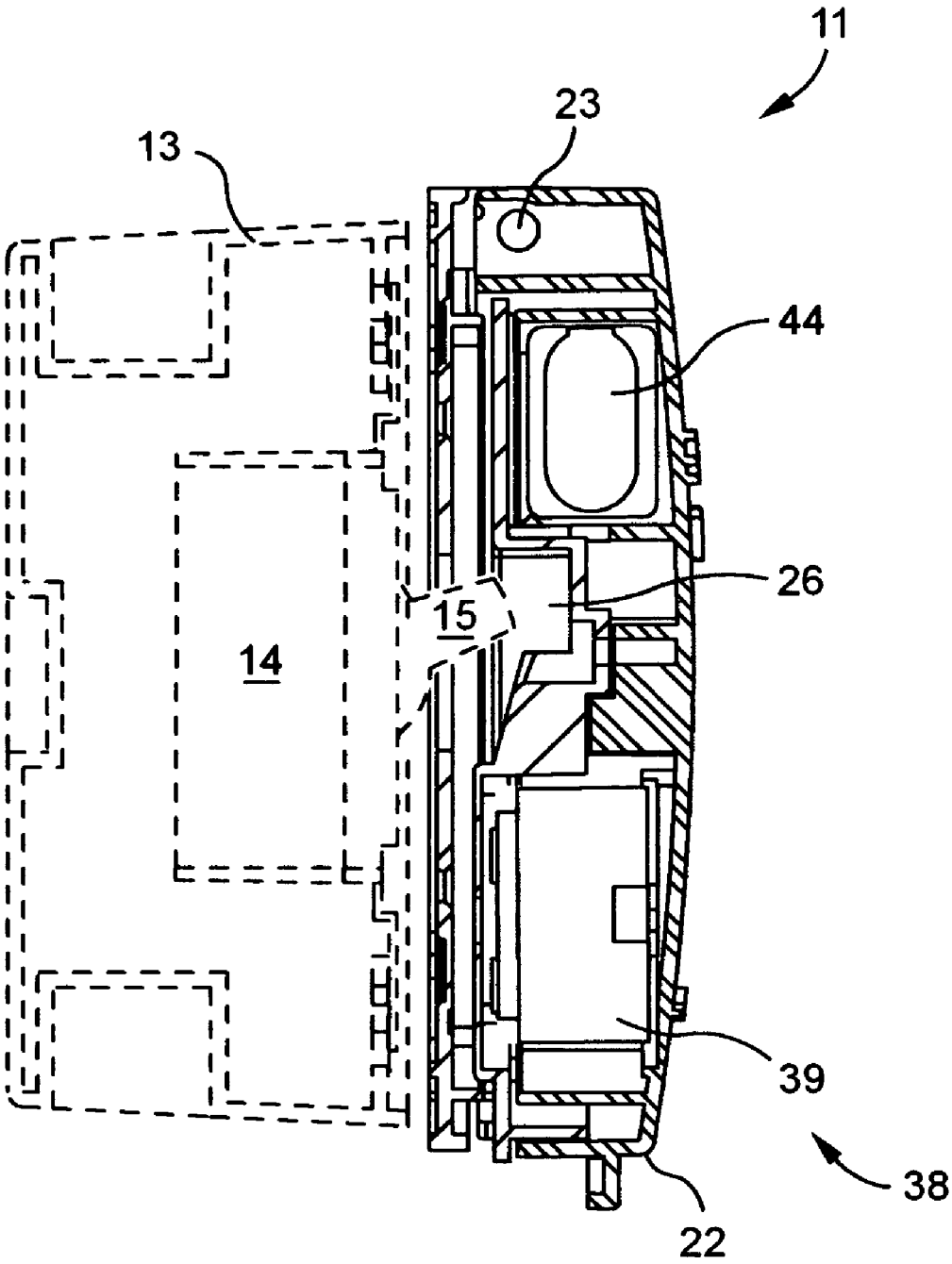
FIGS. 4-5 are illustrative cross sectional views of the emergency shut-off cover plate with hinged cover of FIGS. 2-3 respectively.
Figure 5:
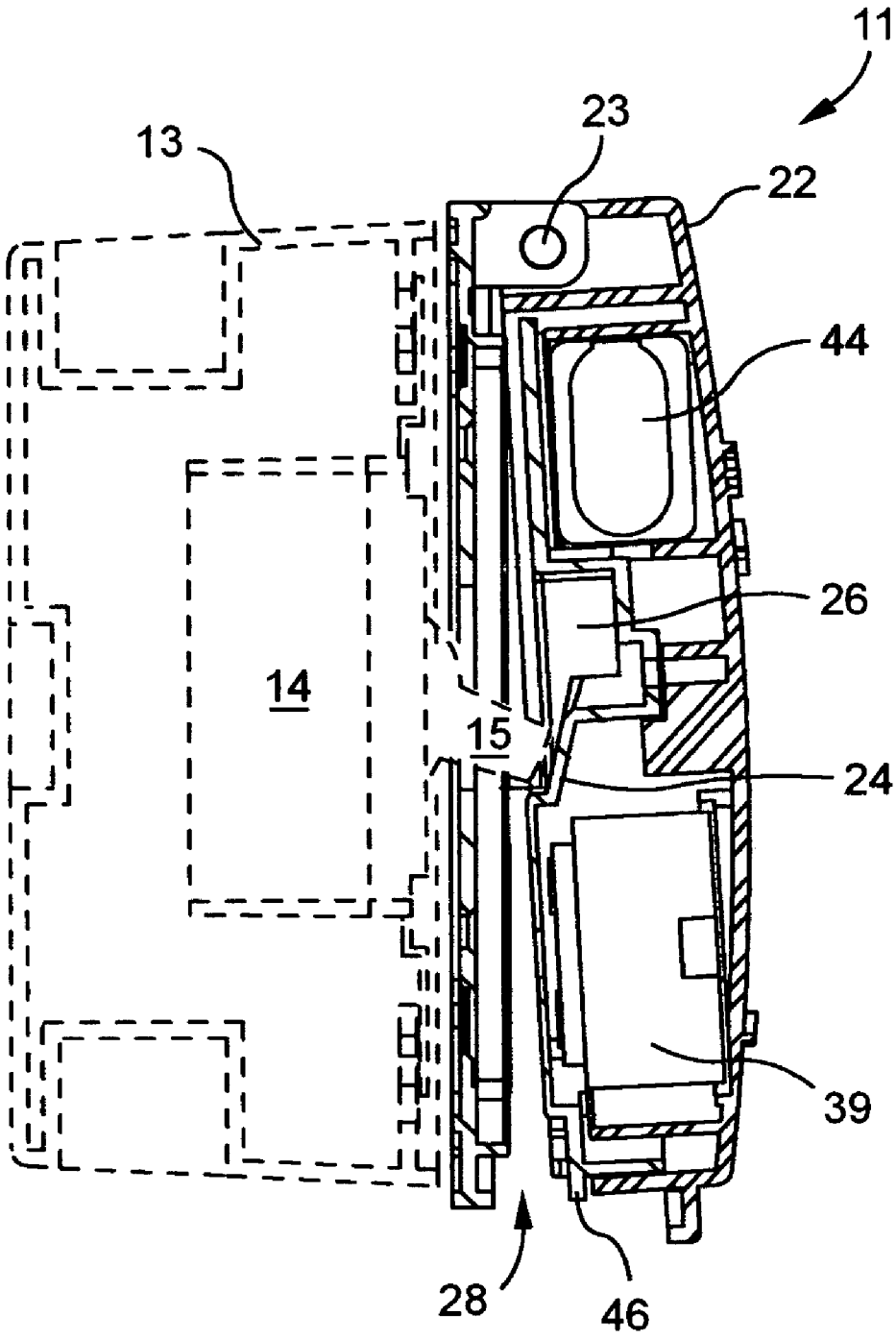
Figure 6:
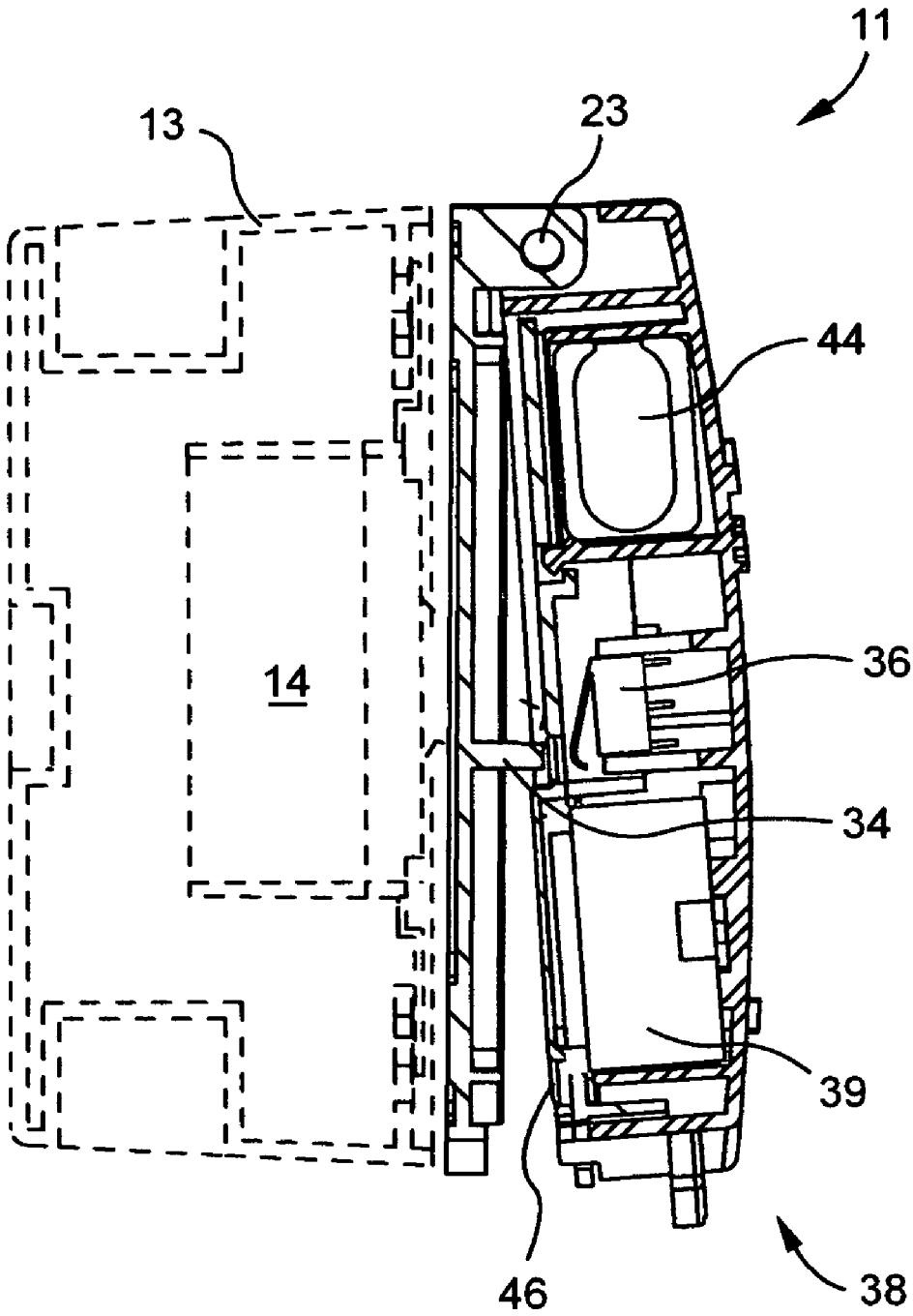
FIG. 6 is an illustrative cross sectional view of the emergency shut-off cover plate with hinged cover showing an extension pin of the cover plate of FIG. 3.

Referring now to the drawings and more particularly to FIGS. 1-3, there is illustrated an emergency shut-off system 10, which is constructed in accordance with the present invention. In the preferred embodiment of the emergency shut-off system 10, the emergency shut-off system 10 helps to prevent the unintended shut-down of a pool or spa water pumping system 12 and provides a pool or spa user or maintenance person with a sensory indication that the pumping system is shut-down and needs to be re-activated. The sensory indication can be either a highly visual indication or in the alternative a combination of the highly visual indication with an audible sensory indication as well.

As best seen in FIG. 1, the emergency shut-off system 10 generally comprises a shut-off alarm box 11, which is mounted to an existing or conventional electrical box 13 that forms part of the pumping system 12. An emergency shut-off switch 14 is mounted within the electric box 13 and includes a finger-engagable member 15 which projects outwardly from the electrical box 13 for immediate access by a user (not shown).

The pumping system 12 is a conventional pool or spa pumping system having a pump 112 in fluid communication with the pool or spa water W through a water drain 114. The pump 112 in turn, is in fluid communication with a jet pump 116 through a conventional water filter 118. The jet pump 116 returns the water W to the pool or spa via a jet outlet 120.

In order to control the operation of the pump 112 and jet pump 116 in a normal mode of operation, both the pump 112 and the jet pump 116 are coupled electrically to a relay box 122. The relay box 122 is coupled between a jet timer 124, which causes the jet pump 116 to be turned on, and turned off for predetermined periods of time, and the emergency shut-off switch 14. In this manner, whenever an emergency situation develops, the emergency shut-off switch 14 may be actuated to cause the pumping system 12 to be immediately shutdown.

As the pool or spa pumping system 12 is conventional and well known to those skilled in the art, the pumping system 12 will not be described hereinafter in greater detail.

Considering now the emergency shut-off system 10 in greater detail with reference to FIGS. 1-6, the emergency alarm box 11 generally includes an emergency shut-off switch cover plate 20 and a hinged switch cover or alarm box 22 that cooperate with the shut-off switch 14, and more particularly with the finger engagable member 15, to help prevent the unintended shut-down of the pool or spa water pumping system 12. The emergency shut-off switch cover plate 20 and the hinged alarm box switch cover 22 function in a closed position to prevent the unintended shut-down of the pumping system 12 by requiring a pool or spa user to place the hinged alarm box cover 22 in an open position in order to activate the emergency shut-off switch 14. Once the emergency shut-off switch 14 has been actuated to its power-off position, the user may release the alarm box cover 23 to allow it fall under the force of a coil spring (not shown) back towards its normally closed position. In the regard, as the alarm box 23 comes to rest between its normally closed position and a fully opened position against the distal end of the finger engagable member 15, the alarm box 11 provides the user with a sensory indication that pumping system 12 is shut-down and needs to be re-activated. As will be explained hereinafter in greater detail, the sensory indication can be either a highly visual indication or in the alternative a combination of the highly visual indication with an audible sensory indication.

As best seen in FIGS. 2-5, the emergency alarm box cover 22 is pivotally mounted to the electric switch cover plate 20 by a hinge 23. The emergency alarm box cover 22 is moveable between an open position to allow the actuation of the shut-off switch 14 via its associated finger-engagable member 15 and a closed position to prevent the actuation of the shut-off switch 14 via its associated finger-engagable member 15.

To facilitate providing the user with a sensory indication of the state of the emergency shut-off switch 14, the emergency alarm box cover 22 includes an obstruction wall 24 and a void space 26. In this regard, the emergency shut-off switch 14 cooperates with the wall 24 and the space 26 to help facilitate sensory indications that can be easily and quickly perceived by the user. More particularly, the obstruction wall 24 engages the distal end of the finger-engagable member 15, when the emergency shut-off switch 14 is actuated to the power off position and the alarm box cover 22 is resting under the force of the coil spring (not shown) at the alarm position generally indicated in FIGS. 3 and 5. In the alarm position (FIG. 5), the alarm box cover 22 is disposed between its fully open position and its fully closed position. The alarm position can be immediately perceived by a very noticeable gap 28 (FIG. 5) that is created between a base portion 30 of the cover plate 20 and a base portion 32 of the alarm box 22.

Conversely, when the emergency switch 14 is disposed in its normally power on position, the distal end of the finger engagable member 15 is disposed in the void space 26, which in turn allows the alarm box cover 22 to return under the force of the coil spring (not shown) to a non-alarm or fully closed position, indicted in FIG. 2. The non-alarm position, like the alarm position can be immediately perceived by the visual indication that the base portion 30 of the cover plate 20 and the base portion 32 of the alarm box 22 are immediately adjacent to one another.

Considering now the cover plate 20 in still greater detail, the cover plate 20 includes a front face or wall 40 having a centrally disposed opening 42. The opening 42 is elongated and is dimensioned for receiving therein for friction free movement the finger engagable member 15 which is coupled mechanically to the emergency alarm switch 14 to cause it to be turned on and off.

In order to help facilitate providing the user or maintenance person with an auditory alarm indication that the emergency shut-off switch 14 is disposed in a power-off position, the cover plate 20 also includes an actuation pin 34 that extends perpendicularly outward from the wall 40. As will be explained hereinafter in greater detail, the actuation pin 34 has a predetermined length to penetrate into the inner space of the alarm box cover 22 a sufficient distance to actuate a micro switch 36 which is mounted in the alarm box cover 22. In this regard, when the pin 34 actuates the micro-switch 36 it causes an alarm system 38 also disposed within the alarm box cover 22 to be shut-off.

Considering now the alarm box cover 22 in greater detail with reference to FIGS. 3-6, the alarm box cover 22 has an open box-like structure, which is generally rectangular. The alarm box cover 22, has sufficient space within its open space area to receive therein the micro-switch 36, the alarm system 38. In this regard, the alarm system 38 generally includes an alarm speaker 39 and a battery 44 that provides power for the speaker 39. A battery cover 46 helps to protect and hold the battery 44 within the cover 22. The micro-switch 36 is mounted in position to be actuated by the cover plate pin 34 when the alarm box cover 22 is resting in its normally closed position. In this position, the power to the alarm system 38 is cutoff preventing the alarm speaker 39 from making an auditory sound.

Conversely, when the alarm box cover 22 is resting in the alarm position with the distal end of the emergency shut-off switch 14 finger engagable member 15 is in engagement with the obstruction wall 24, with the cover plate pin 34 disengaged from the micro-switch 36. In this configuration power is supplied to the alarm system 38 so that an auditory sound is made by the alarm speaker 39 to provide the user or maintenance persons with an immediate indication that the pool pumping system 12 is in a shutdown or power-off condition.

Considering the alarm box 22 in still greater detail, the alarm box 11 is generally bright red in color and includes indicia to provide a user with an visual indication of the location of the emergency shut-off switch 14. In this manner, a user can immediately located the emergency shut-off switch 14 in an emergency situation that would require the shutdown of the pumping system 12.

In the preferred embodiment, the emergency shut-off system 10 has been described as having a battery-powered alarm. It should be understood however by those skilled in the art, that an electric power connection can be provided to the micro-switch 36 so that direct power may be provided to the alarm system 38 in lieu of battery power. It should also be understood by those skilled in the art that other sensory indictors may be provided. For example, a light emitting diode could flash on and off to provide a further visual indication that an alarm condition exists. Therefore, while a particular embodiment of the present invention has been disclosed, it is to be understood that various different modifications are possible and are contemplated within the true spirit and scope of the appended claims. There is no intention, therefore, of limitations to the exact abstract or disclosure herein presented.

I claim:

1. An emergency shut-off system, comprising:

an electric switch cover plate, said plate having an opening for receiving therethrough a finger-engagable shut-off switch;

an emergency alarm box movably mounted to said electric switch cover plate actuation movable to a closed position whereat said box is juxtaposed over said cover plate opening for covering and protecting said finger-engagable shut-off switch from accidental actuation to a power-off position, said emergency alarm box is further moveable between an open position to allow the actuation of said finger-engagable shut-off switch and said closed position to prevent the actuation of said finger-engagable shut-off switch; and said emergency alarm box providing a sensory alarm indication to a user when said finger-engagable shut-off switch is actuated to said power-off position, or said alarm box is moved away from said closed position, said emergency alarm box further including an obstruction wall and a void space.

2. The emergency shut-off system according to claim 1, wherein said obstruction wall engages a distal end of said finger-engagable switch when said emergency shut-off switch is actuated to said power off position and said alarm box is resting under the force of a coil spring biasing said alarm box towards said closed position.

3. The emergency shut-off system according to claim 2, wherein said finger-engagable switch is disposed in said void space when said emergency shut-off switch is actuated to a power on position and said alarm box is resting under the force of the coil spring in said closed position.

4. The emergency shut-off system according to claim 3, wherein when said obstruction wall engages the distal end of said finger-engagable switch the user is provided with a visual indication that said finger-engagable switch is in a power-off condition.

5. The emergency shut-off system according to claim 4, wherein when the distal end of said finger engagable switch is disposed within the void of said alarm box, the user is provided with a visual indication that said finger-engagable switch is in a power-on condition.

6. The emergency shut-off system according to claim 1, wherein said emergency alarm box includes a switch actuated alarm and wherein said cover plate includes an alarm actuation pin;

said alarm actuation pin causing said switch actuated alarm to provide an auditory sound when said alarm box is disposed in an alarm position between a fully closed position and a fully open position.

7. The emergency shut-off system according to claim 1, wherein said alarm box includes emergency indicia disposed thereon to provide a user with a visual indication of the location of said finger-engagable power switch in an emergency situation.

8. A method of providing a sensory indication of a pumping system operating condition, comprising the steps of:

providing an electric switch cover plate, said plate having an outwardly projecting actuation pin and an opening for receiving therein a finger-engagable shut-off switch; an emergency alarm box movably mounted to said electric switch cover plate for covering and protecting said finger-engagable shut-off switch from accidental actuation; said emergency alarm box having an obstruction wall for engaging said finger-engagable shut-off switch when it is disposed in a power off position and a void for receiving therein said actuation pin said finger-engagable shut-off switch when it is disposed in said power off position; and said emergency alarm box providing a sensory alarm indication to a user when said finger-engagable shut-off switch is actuated to a power-off position; and moving said emergency alarm box away from said finger-engagable shut-off switch a sufficient distance to actuate said finger-engagable shut-off switch to shut down the pumping system; and releasing said emergency alarm box to allow it to fall under the force of a spring and to come to rest in an alarm position disposed between said full opened position and a fully closed position, wherein said obstruction wall engages said finger-engagable shut-off switch and said actuation pin is disposed in said void to provide a user with a sensory alarm of a pumping system shut-down.

9. The method of providing a sensory indication of a pumping system operating condition according to claim 8 further comprising the steps of:

moving said emergency alarm box away from said finger-engagable shut-off switch a sufficient distance to actuate said finger-engagable shut-off switch to power-up the pumping system; and releasing said emergency alarm box to allow it to fall under the force of said spring and to come to rest in a non-alarm position to provide a user with a sensory indication that the pumping system is operational.

10. The method of providing a sensory indication according to claim 9, further comprising the steps of:

providing said alarm box with emergency indicia to provide a user with an visual indication of the location of said finger-engagable shut-off switch in an emergency situation that would require the shut-down of the pumping system.

* * * * *